United States Patent [19]

Suzuki et al.

[11] Patent Number: 4,592,819

[45] Date of Patent: Jun. 3, 1986

[54] ELECTROPLATING APPARATUS WITH VENTILATION MEANS

[75] Inventors: Toshiyuki Suzuki, Hamakita; Hiroshi Tsukakoshi, Iwata, both of Japan

[73] Assignee: Yamaha Hatsudoki Kabushiki Kaisha, Iwata, Japan

[21] Appl. No.: 707,176

[22] Filed: Feb. 28, 1985

Related U.S. Application Data

[63] Continuation of Ser. No. 354,180, Mar. 3, 1982, abandoned.

[30] Foreign Application Priority Data

Mar. 3, 1981 [JP] Japan ..... 56-30086

[51] Int. Cl.[4] ..... C25D 5/00; C25D 17/00

[52] U.S. Cl. ..... 204/203; 204/237; 204/276; 204/277; 204/278; 204/DIG. 13

[58] Field of Search ..... 204/198, 203, 275, 276, 204/278, DIG. 13, 237, 270, 277

[56] References Cited

U.S. PATENT DOCUMENTS

| | | | |
|---|---|---|---|
| 1,731,456 | 10/1929 | Eaton | 204/278 X |
| 3,573,186 | 3/1971 | Ryerson et al. | 204/203 |
| 3,661,732 | 5/1972 | Withrow | 204/278 X |
| 4,445,992 | 5/1984 | Yamamoto | 204/203 |

FOREIGN PATENT DOCUMENTS

| | | | |
|---|---|---|---|
| 2719680 | 11/1978 | Fed. Rep. of Germany | 204/203 |

*Primary Examiner*—Donald R. Valentine

*Attorney, Agent, or Firm*—Donald D. Mon; David O'Reilly

[57] ABSTRACT

A ventilating system for a high speed electroplating apparatus having a pretreating section, a plating section and a post treating section for electroplating a workpiece sequentially transferred from each section by a conveyor. Each section has a cover which together completely enclose the apparatus except for inlet and outlet areas. An exhaust fan is positioned in a duct connected to the enclosed treating sections for exhausting the accumulated gases to the atmosphere outside the work area.

2 Claims, 4 Drawing Figures

ELECTROPLATING APPARATUS WITH VENTILATION MEANS

This is a continuation of co-pending application Ser. No. 354,180 filed on Mar. 3, 1982, now abandonded.

FIELD OF THE INVENTION

The present invention relates to a plating apparatus for preventing the atmospheric environment around a plating site from being contaminated.

BACKGROUND OF THE INVENTION

Generally speaking, an electric plating operation requires both a pretreatment for deoiling, rinsing and so on, a work to be plated and a posttreatment for rinsing this work plated, and those respective treatments are frequently arranged sequentially in the order of the steps.

Around the plating site, however, forced vapors of the plating liquid or other respective treating liquids are generated due to the natural volatilation or the drying treatment thereby contaminating the working environment. The contamination of such ambient air will not only promote the corrosion of the surrounding mechanical facilities but also invite problems to the health of human bodies.

BRIEF DESCRIPTION OF THE INVENTION

The present invention has been conceived in view of the background thus far described and contemplates providing a plating apparatus for preventing the ambient air from being contaminated thereby to keep the working environment clean, partly by covering a pretreating bath, a plating apparatus and a posttreating bath with a cover and partly by forcibly exhausting that covered space.

The present invention will be described in the following description in connection with one embodiment thereof with reference to the accompanying drawings.

DETAILED DESCRIPTION OF THE INVENTION

Figure 1:
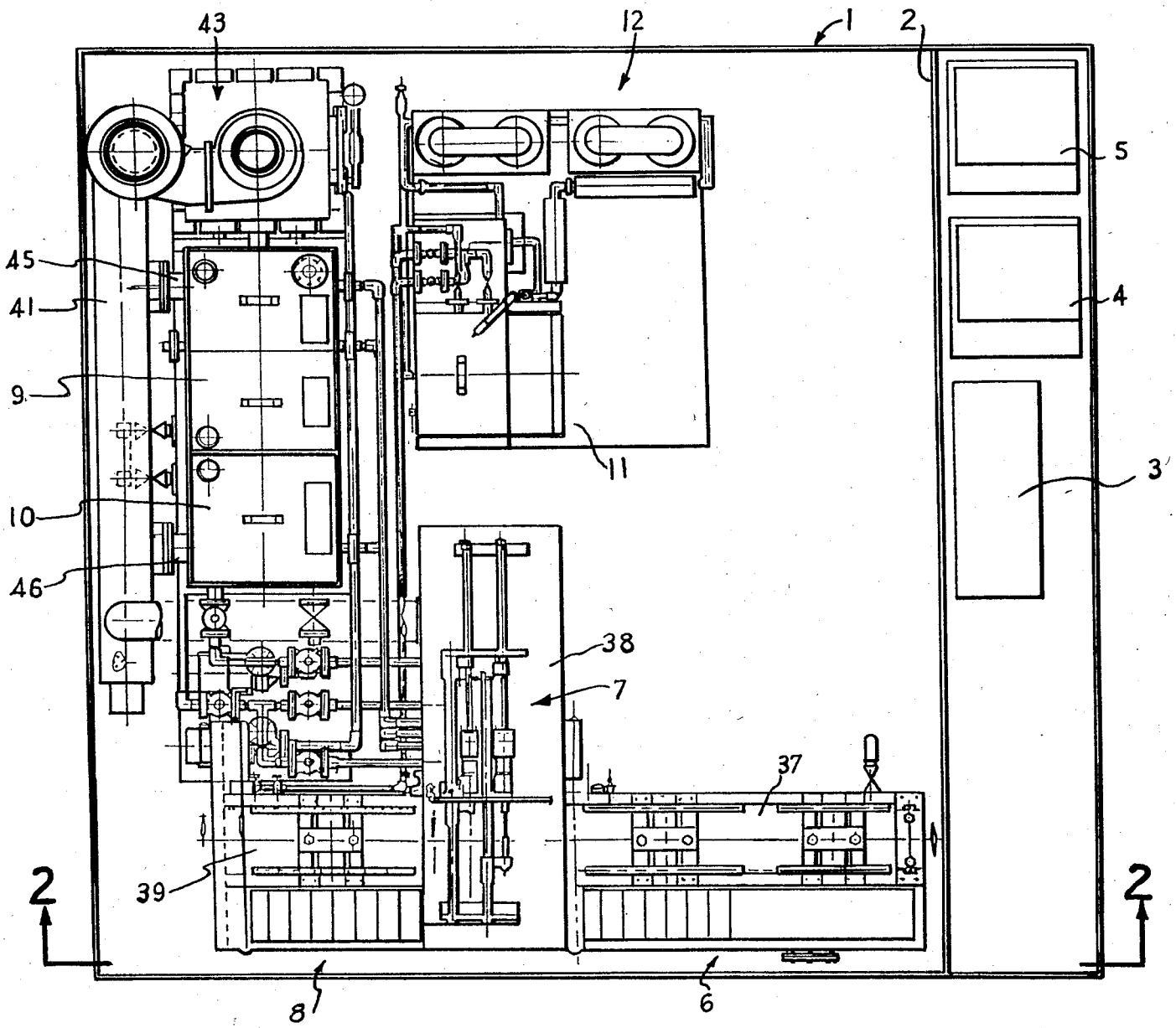
FIG. 1 is a top plan view showing the overall construction of the plating apparatus according to the invention.
Figure 2:
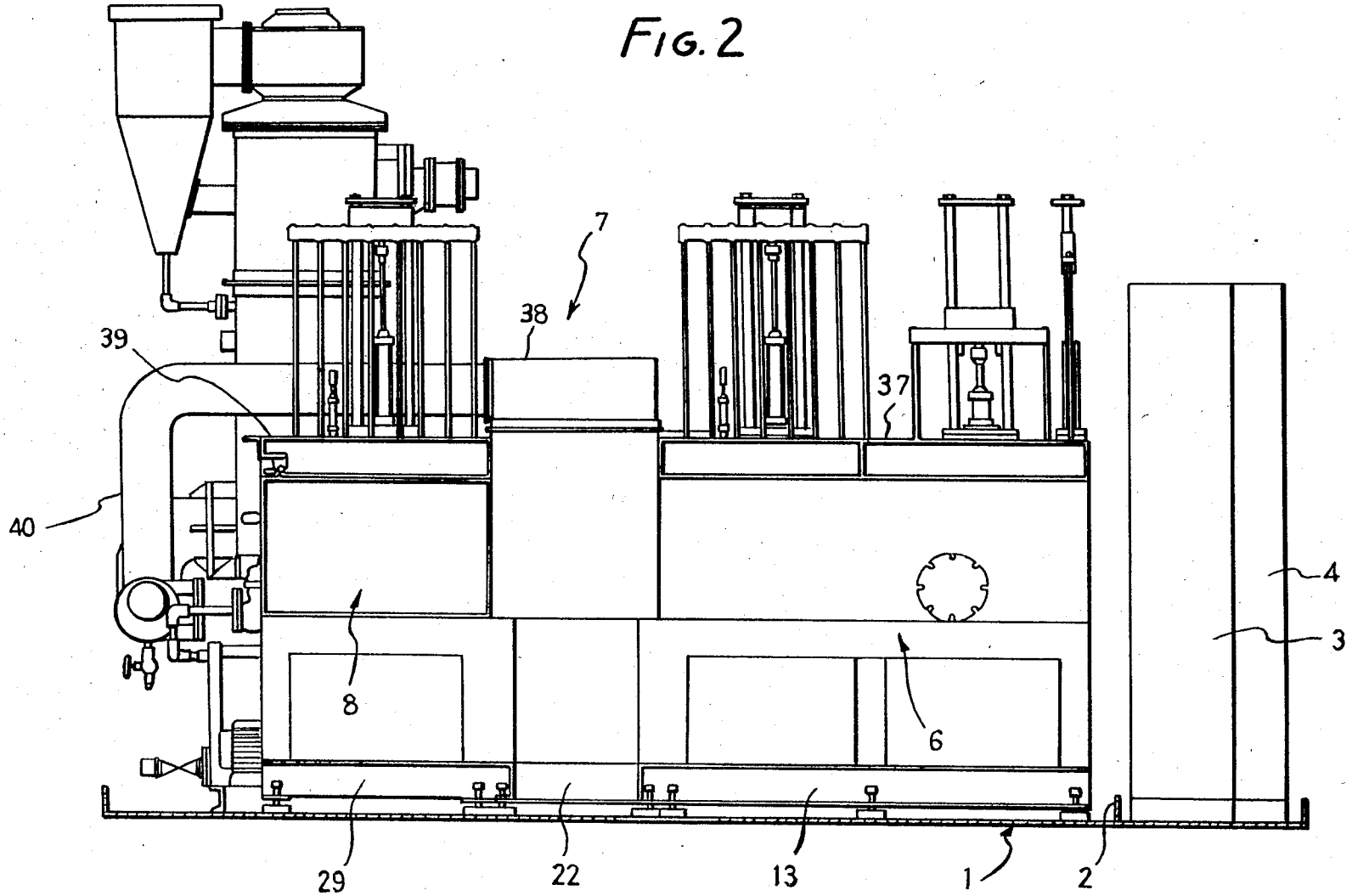
FIG.2 is a view taken at II—II of FIG. 1.

In the drawing a pallet 1 is formed into a shallow pan having a rectangular shape. The pallet 1 is divided by a partition 2 into compartments, one of which is equipped with a sequence control board 3 and rectifiers 4 and 5. At the other side of the partition 2, a pretreating bath 6, a high speed plating unit 7 and a posttreating bath A are juxtaposed in the specified order, and a plating liquid tank 9, a back-electrolyte tank 10, a pure water tank 11 and a pure water circulating cleaner 12 are placed thereon.

Figure 3:
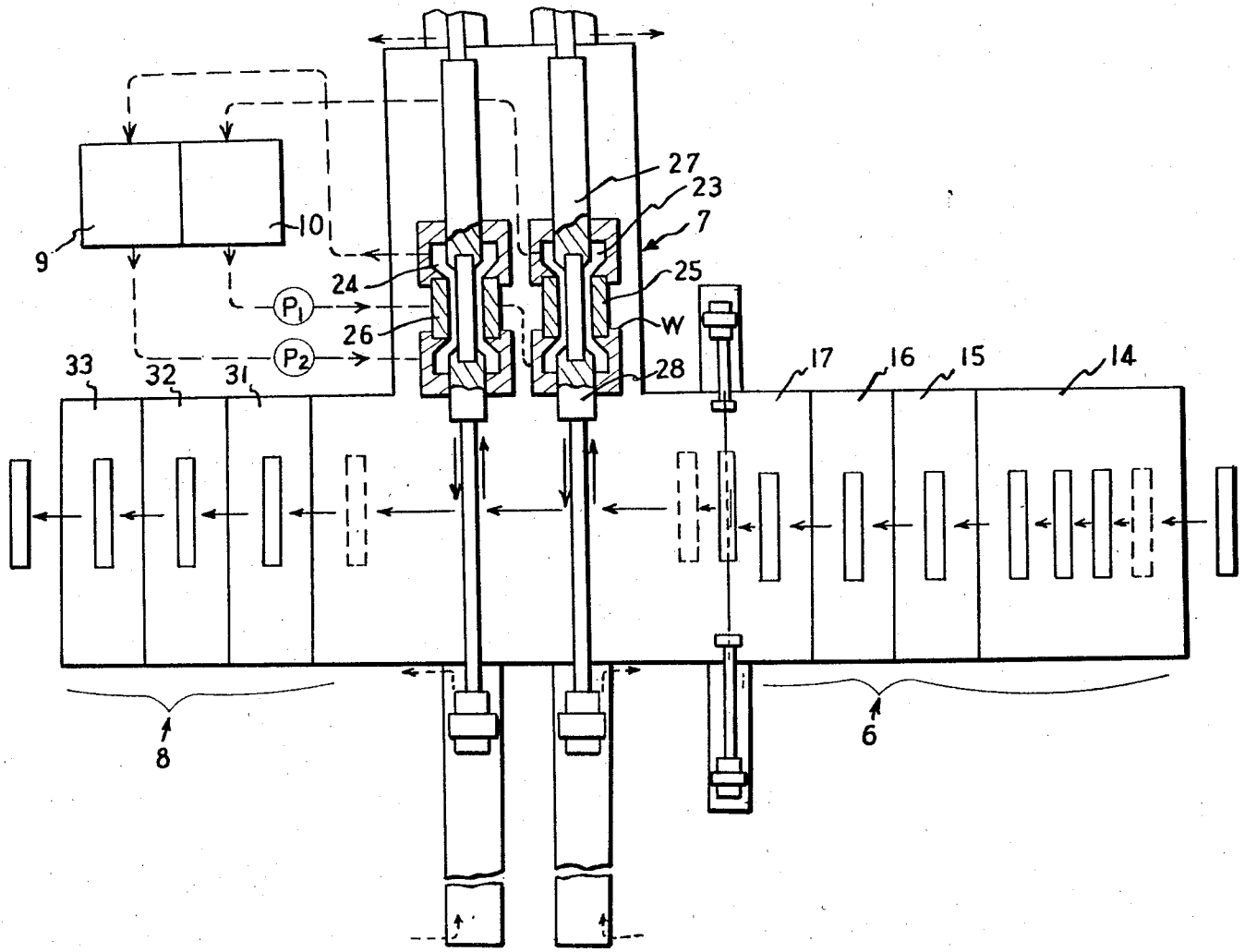
FIG. 3 is a semi-schematic top plan view with the covers removed illustrating feeding of work pieces to be plated.
Figure 4:
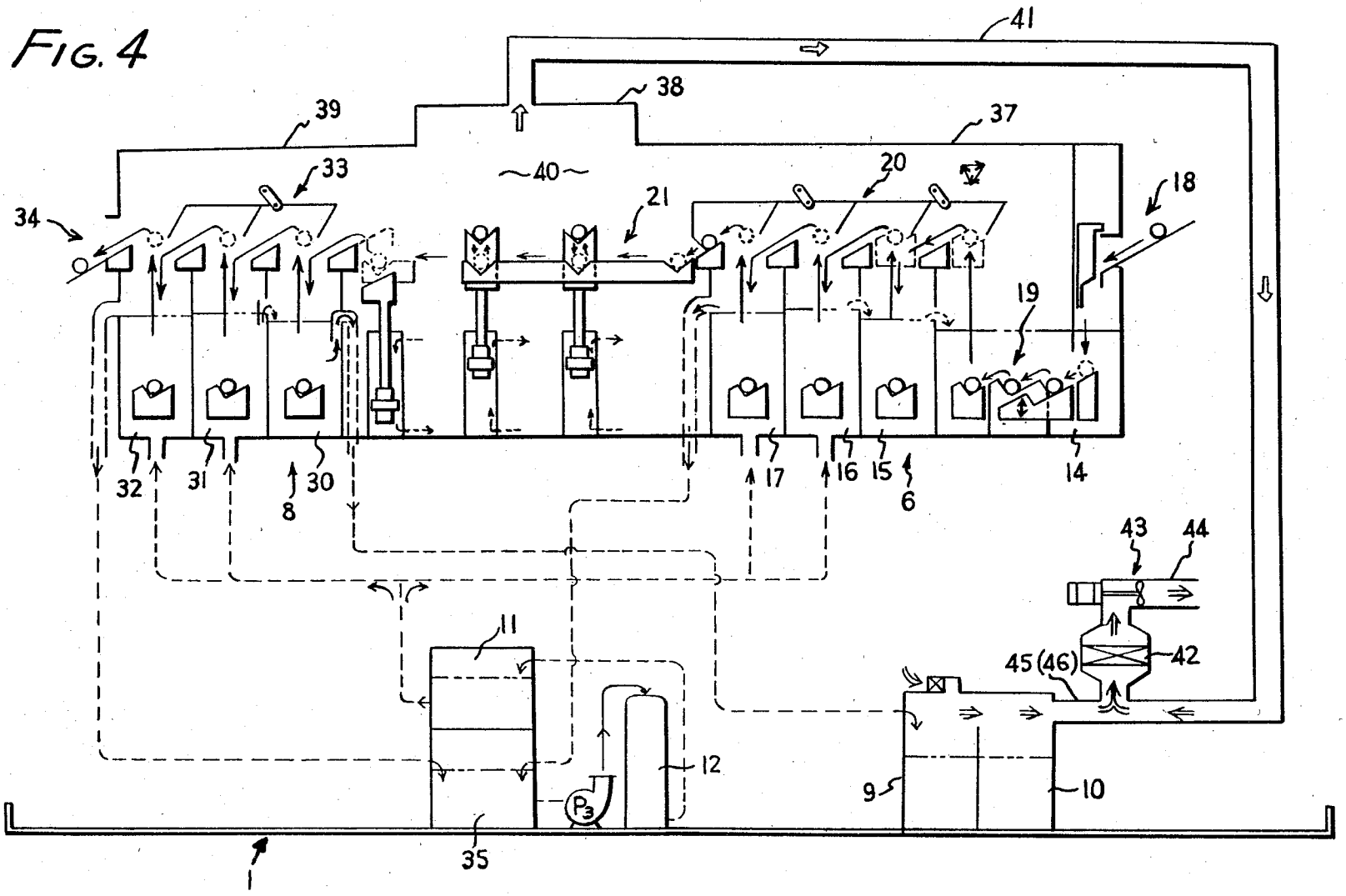
FIG. 4 is a schematic illustration of the feeding of work pieces to the plating apparatus and the piping system.

The aforementioned pretreating bath 6 is placed on a platform 13 and is made to have a construction as is schematically shown in FIGS. 3 and 4. More specifically the pretreating bath 6 is composed of a deoiling bath 14, which is filled up with an aqueous solution of sodium carbonate having caustic soda (NaOH) added thereto, and first to third rinsing bathes 15, 16 and 17. These rinsing bathes 15, 16 and 17 are filled up with pure water such that the second rinsing bath 16, the first rinsing bath 15 and the deoiling bath 14 have stepped liquid levels which produce consecutive overflows. At the righthand and of the deoiling bath 14, there is disposed an inlet chute 18 through which works (W) are consecutively poured one by one. In the deoiling bath 14, there is disposed below the liquid surface a conveyor 19 for consecutively conveying the works (W). Between the respective deoiling bathes 14 and the first to third rinsing bathes 15, 16 and 17, there is interposed a transfer machine 20 for transferring those works (W) from one bath to the next bath.

The work (W) having been deoiled and rinsed by the aforementioned pretreating bath 6 are conveyed by the action of a conveyor 21 to the posttreating bath 8 so that it is plated midway thereof. More specifically, the plating treatment is produced by the action of the high speed plating unit 7, which is equipped on a platform 22 with a back- electrolyzing chamber 23 and a plating chamber 24 positioned to extend in a direction perpendicular to the conveying line of the aforementioned conveyor 21. Those respective back electrolyzing chamber 23 and plating chamber 24 respectively form confined chambers and are equipped with electrodes 25 and 26 in their side walls. The work (W) accommodated in that back electrolyzing chamber 23 has its surface layer etched by electrically connecting the electrode 25 of the back electrolyzing chamber 23 as a cathode and by connecting that work (W) with an anode. Into that back electrolyzing chamber 23, incidentally, there is injected a liquid, which has the same quality as that of the plating liquid but is diluted, such as a solution of chromic acid (for chromium plating). On the other hand, the plating chamber 24 is so electrically connected that the electrode 26 acts as the anode while the work (W) acts as the cathode, and the plating liquid such as the solution of chromic acid is injected into that plating chamber 24.

Incidentally, the work (W) is held in the back electrolyzing chamber 23 and the plating chamber 24 and transferred from the conveyor 21 by action of holders 27 and 28.

Moreover, the back electrolyte and the plating liquid communicate with the back-electrolyte tank 10 and the plating liquid tank 9, respectively, and are circulated by pumps $P_1$ and $P_2$, respectively. By these circulations, flows of the respective liquids are established in the back-electrolyte chamber 23 and the plating chamber 24 so that the liquid layers in the vicinity of the surface of the work (W) are continuously exchanged to produce the high speed etching and plating treatments.

The posttreating bath 8 is placed on another platform 29 and is composed of first to three rinsing bathes 30, 31 and 32. Between these first to third rinsing bathes 30, 31 and 32, there is disposed a transfer machine 33 which is similar to the transfer machine 20 of the aforementioned pretreating bath 6 to consecutively transfer the work (W), which has been plated, between the respective rinsing bathes 30, 31 and 32. Incidentally, numeral 34 indicates an outlet chute.

Moreover, the second and third rinsing bathes 16 and 17 of the pretreating bath 6 and the second and third rinsing bathes 31 and 32 of the posttreating bath 8 are supplied with pure water from the pure water tank 11, as shown in FIG. 4. On the other hand, the respective third rinsing bathes 17 and 32 return the overflown water into a pure tank return water 35. This return tank 35 supplies the pure water to the pure water circulating cleaner 12, e.g., an ion exchanger 35, by which the pure water is cleaned before it is supplied to the pure water tank 11. As a result, the pure water is cleaned and purified so that it need not be discharged to the outside nor continuously replaced. Incidentally, the pure water, which has overflown the first rinsing bath 15 of the pretreating bath 6, is used as supply water to the deoiling bath 14, whereas the pure water, which overflows the first rinsing bath 31 of the posttreating bath 8, is used as supply water to the plating liquid.

In the construction thus far described, the aforementioned pretreating bath 6, high speed plating unit 7 and posttreating bath 8 are covered with covers 37, 38 and 39, respectively, so that the spaces defined by those respective covers 37, 38 and 39 provide an enclosed space 40. Moreover, this enclosed space 40 is vented to the atmosphere through the portions of the aforementioned inlet and outlet chutes 18 and 34. In other words, those inlet and outlet chutes 18 and 34 provide ambient air inlets for introducing ambient air from the outside into the enclosed space 40. With this enclosed space 40, moreover, there communicates an exhaust duct 41 which leads to an exhaust fan 43 acting as a pump through a filter 42 which is made of cloth or corrosion resisting fibers. And, that exhaust fan 43 is vented to the atmosphere outside of the factory by way of an exit duct 44.

On the other hand, the upper spaces above the aforementioned plating liquid tank 9 and back-electrolyte tank 10 communicate through passages 45 and 46 with the aforementioned exhaust duct 41.

The operations of the plating apparatus having the construction thus far described will be described in the following.

The works (W), which are poured one by one from the inlet chute 18 of the pretreating bath 6, are dipped in the deoiling bath 14 to remove the oil components therefrom. Then, those works (W) are consecutively transferred to the first to third rinsing bathes 15, 16 and 17 so that they are dipped in the respective bathes 15 to 17 to have their surfaces rinsed.

The works thus rinsed are transferred to the back-electrolyzing chamber 23, in which they have their surfaces etched. By these etching treatments, any impurity is removed from the surfaces of the works, and the contact between of the base with the plated layer is increased to improve the adhesion strength.

Then, the works (W) having been back-electrolyzed are transferred to the plating chamber 24, in which they are plated. Since, during those plating treatments, the plating liquid is injected into the plating chamber 24, it flows at all times so that the works (W) always have their surfaces supplied with a renewed plating liquid. As a result, the growth of the plating layer is accelerated to make the high speed plating treatment possible.

The works (W) having been plated are transferred in the posttreating bath 8 among the respective rinsing bathes 31, 32 and 33 so that they are rinsed to be cleared of the plating liquid. After that, the works (W) thus rinsed are taken out through the outlet chute 34.

Thus, according to the construction thus far described, the high speed plating unit 7 is reduced in size. More specifically, the aforementioned high speed plating unit 7 can be reduced in size and still produce high speed treatments in comparison with the prior art unit, in which the works (W) are merely dipped in the plating liquid, because the works (W) are dipped in the plating chamber 24 having a small capacity, in which the plating liquid flows, so that the unit has its whole size reduced. In other words, the pallet 1 can be a small size.

Moreover, the back-electrolyte and the plating liquid are stored in the tanks 10 and 9, respectively, and circulated by the pumps $P_1$ and $P_2$, and the pure water is circulated by the circulating cleaner 12 such as the ion exchanger. As a result, the circulating passages of those liquids can be wholly assembled on the pallet 1. In other words, any liquid supply and discharge system outside of the pallet 1 can be dispensed with.

Since the respective baths, tanks and machines are wholly placed on any pallet 1, moreover, the liquids having leaked from the pipes or as a result of the corrosions by the plating liquid, if any, are received by that pallet 1 so that they never flow to the outside of the pallet 1. Especially, the outflow of the plating liquid leads to not only a disadvantage that the surrounding machines or facilities are corroded but also a disadvantage in that the ambient air around the working site is contaminated. That outflow of the plating liquid is prevented by the aforementioned pallet 1 so that the resultant damage can also be prevented.

Therefore, the high speed plating apparatus would have a small size and would be equipped with a liquid circulating system so that it could be installed in an arbitrary place in the factory and shifted, if necessary, so that it could be combined with a suitable portion of any working or assembly line. At the same time, if the working or assembly line were changed, that high speed plating apparatus could be easily installed at a shifted position according to that change. With pallet 1, there can be attained the advantage that it is unnecessary to perform works or constructions on a large scale, for example, the troublesome of digging of pits.

On the other hand, the pretreating bath 6, the high speed plating unit 7 and the posttreating bath 8 are covered with those covers 37, 38 and 39, and the resultant enclosed space 40 is forcibly exhausted by means of the exhaust fan 43 so that the gas components, which are evaporated either naturally or by the forced drying process from the respective treating bathes, are instantly discharged to the outside of the factory. Moreover, the plating liquid, which has oozed through the leakage at the seals until it has been gasified, is also discharged by way of the ducts 41 and 44. Since, in this case, the enclosed space 40 is supplied with fresh air through the openings of the inlet and outlet chutes 18 and 34, the enclosed space 40 is prevented from being excessively evacuated thereby preventing fear that the gasification of the plating liquid is unnecessarily promoted.

In the plating liquid tank 9 and the back-electrolyte tank 10, moreover, the gas components having been naturally evaporated are discharged through the fan 43 so that the tanks 9 and 10 are cleared of the evaporated components to prevent environmental contamination due to a leak. Therefore, since the atmosphere around the plating apparatus is not contaminated by the plating liquid or the like, the various machines and facilities of the surrounding working or assembly lines corrosion is reduced, and the health of the workers is not damaged.

Still moreover, since the air to be discharged to the outside of the factory is cleaned by the filter 42, the air pollution around the factory is also prevented.

Although, in the aforementioned embodiment, the high speed plating unit 7 is described, the present invention should not be limited thereto but may be applied to any dip type plating apparatus which is well known in the art.

As has been described hereinbefore, according to the present invention, at least the pretreating bath, the plating unit and the posttreating bath are covered with the covers thereby to form the enclosed space, and this enclosed space is discharged by means of the fan. As a result, according to the present invention, either the gas components of the respective liquids, which have been naturally or forcibly evaporated in the pre- and post-treating baths and the plating bath, or the gas components, which have been evaporated because of the leakage of the liquid, are forcibly discharged, whereby the present invention has advantages preventing the working environment from being contaminated, reducing corrosion of the surrounding facilities, and improving safety by reducing health hazards to humans.

We claim:

1. An electroplating apparatus with ventilating means comprising:

a plurality of tanks arranged in a sequential series partitioned into a pretreating section, an electroplating section and a post-treating section;

conveying means conveying workpieces consecutively through said plurality of tanks from one section to another;

said electroplating section comprising smaller confined chambers displaced perpendicular to the path of said conveying means;

holding means for holding and transferring said workpieces consecutively from said conveying means to said electroplating section and back to said conveying means;

cover means covering said plurality of tanks and said conveyor means;

inlet means at one end of said cover means providing an inlet to said pretreating section, said inlet being open to ambient air;

outlet means at a second end opposite said one end providing an outlet for plating workpieces, said outlet being open to ambient air;

circulating means continuously circulating electroplating liquids through the smaller confined chambers of said electroplating section;

duct means connecting the enclosure formed by said cover means with the atmosphere outside the work area remote from said electroplating apparatus;

an exhaust fan interposed in said duct means for exhausting accumulated fumes from said covered enclosure and said plating liquid tank to said atmosphere;

filter means between said cover enclosure and enclosed tank for filtering accumulated gases before discharge by said exhaust fan.

whereby a compact, high-speed in-line fully ventilated electroplating system is provided in which air is drawn into said plating apparatus through said inlet and outlet means over said pretreating, electroplating and post-treating sections by said exhaust fan for discharge through said duct means.

2. The apparatus according to claim 1 in which said electroplating section includes a back-electrolyte chamber and a plating chamber; said holder means consecutively transferring said workpiece from said back-electrolyte chamber to said plating chamber; said duct means constructed and arranged to collect fumes from said electroplating section and said circulating means.

* * * * *